United States Patent [19]

Le Cover

[11] Patent Number: 4,461,308

[45] Date of Patent: Jul. 24, 1984

[54] TOBACCO SMOKE FILTERS

[75] Inventor: Maurice Le Cover, Los Angeles, Calif.

[73] Assignee: Leslie N. Aikman, Corona del Mar, Calif.

[21] Appl. No.: 273,132

[22] Filed: Jun. 12, 1981

[51] Int. Cl.[3] ..... A24D 3/02; A24D 3/04

[52] U.S. Cl. ..... 131/198 R; 131/198 A; 131/336

[58] Field of Search ..... 131/198 R, 198 A, 215 B, 131/215 R, 215 A, 216, 200, 201, 206, 210, 211, 212 R, 212 A, 227, 228, 229

[56] References Cited

U.S. PATENT DOCUMENTS

| | | | |
|---|---|---|---|
| 3,323,525 | 6/1967 | Miller | 131/198 R |
| 3,636,960 | 1/1972 | Blount et al. | 131/210 |
| 4,344,444 | 8/1982 | Miura | 131/201 |

FOREIGN PATENT DOCUMENTS

| | | | |
|---|---|---|---|
| 0019132 | of 1910 | United Kingdom | 131/215 B |
| 0018860 | of 1910 | United Kingdom | 131/215 B |
| 0279361 | 10/1927 | United Kingdom | 131/215 B |

*Primary Examiner*—V. Millin

*Attorney, Agent, or Firm*—Grover A. Frater

[57] ABSTRACT

A filter for cigarette smoke is formed by a generally tubular member (10) having a primary barrier wall (24) extending across the midregion of its interior. Smoke is accelerated from the upstream chamber to the downstream chamber (50) in the filter through a small accelerating opening (26) in the midregion of that barrier. A downstream target, or barrier (28), whose surface area is no greater than the cross-sectional area of the accelerating opening is placed downstream from the opening at a distance which is preferably no greater than the diameter of the accelerating opening. Collection vanes (52–56) at the upstream end of the downstream chamber (50) are formed downstream from the barrier (24) combine with the action of the target (28) to separate liquids and semi-solids from the smoke, and to collect them, at the upstream end of the downstream chamber (50).

15 Claims, 7 Drawing Figures

TOBACCO SMOKE FILTERS

TECHNICAL FIELD

This invention relates to improvements in tobacco smoke filters and to methods for producing them.

BACKGROUND ART

There is a class of tobacco smoke filter which utilizes a differential in the kinetic energy of smoke and of liquid and semi-liquids entrained in the smoke to separate and then trap the liquid and semi-liquid constituents. Many of the filters which rely on that principal are very effective in removing tars and nicotine. But, design has been a matter of art rather than a science, and most design approaches have failed.

The most successful approach appears to have originated with Lebert and can be traced through the work of Thomas and the work of Aikman. Lebert, U.S. Pat. No. 2,954,772 put a barrier across the flowpath of a cigarette holder, a smoke accelerating hole through the middle of the barrier, and a second barrier downstream in the path of smoke passing through the accelerating opening. The smoke and entrained liquids and semi-liquid particles were accelerated toward the second barrier when the smoker applied suction pressure by inhaling. In that process the entrained particles acquired kinetic energy more than did the smoke. The smoke flowed around the second barrier, but the entrained particles could not. They impinged and collected on the face of the second barrier.

The Lebert filter was technically, but not commercially, successful. Thomas made a more commercial product by adding an ambient air inlet upstream from the first barrier. His patents, U.S. Pat. Nos. 3,810,476, 3,926,199 and 3,548,835, also reveal an attempt to move the collection of entrained liquids and semi-solids away from the face of the second barrier to avoid the buildup of trapped matter in front of the accelerating opening. He converted the opening to a lateral passage which opened opposite the inside wall of the downstream chamber whereby collection occured over a broader area.

Aikman, as shown in U.S. Pat. No. 4,038,904, adopted the kinetic energy differential separation principle of Lebert and the air inlet of Thomas. He succeeded in accomplishing adequate separation in regions downstream from the second barrier.

What characterizes the work of all three of these prior inventors is that their filters had to be arranged in relatively long structures. Lebert and Thomas put their filters inside conventionally shaped cigarette holders. Aikman modified the external appearance somewhat, but all three made cigarette holders with filter elements inside. The cost of such structures was too great to be treated as throw-away units. They had to be made in a way that permitted disassembly for cleaning or replacement of the filter element. No one could successfully remove the second barrier and, as a consequence, one-piece, throw-away construction was not possible.

The addition of the ambient air inlet converted the filter-in-a-cigarette-holder device to one that was an aid to those users who wanted to withdraw from the smoking habit, and sets of filter holders, each with a different sized ambient air inlet, became known as "smokers' withdrawal kits." Holders were used over and over. They had to be cleaned and preserved and, ultimately for most smokers who used them, their use simply became part of the smoking habit rather than a means to quitting smoking. The industry looked for, but failed to find, what was predicted to be a better aid to quitting, or at least a less expensive way to filter out of the smoke a large share of the tars and nicotine products. It failed to find a one-piece disposable filter.

Building the filter inside the cigarette itself proved not to be the answer. The best technology for withdrawal filters requires the provision of ambient air for condensing out the liquids containing tar and nicotine and to collect the condensed materials in a fashion that insures against their reentry into the smoke stream. The makers of cigarettes are not motivated to adopt filtration of the kind that aids in overcoming the smoking habit.

The purpose of this invention is to apply the best filtration technology, the technology which can aid some smokers to give up smoking, in a very low cost unit which can be considered to be disposable.

DISCLOSURE OF THE INVENTION

The invention is based in part on the discovery that the downstream barrier need not present a broad area or wall in the path of the smoke as it flows through the accelerating opening (or passageway). The second barrier, or target, need be no larger in area than the cross-sectional area of the accelerating opening. If the second barrier is centered downstream from the accelerating opening, smoke is free to flow around the edges and past the downstream barrier. Far from destroying the effectiveness of the downstream barrier, that arrangement results in deposition of tar and nicotine on the inner walls of the passage downstream from the first barrier but upstream from the downstream barrier. That can only result from a turbulence caused by the second barrier or target. Moreover, the effect is enhanced in some degree if the target is smaller in area than the cross-sectional area of the accelerating opening. The preferred form is a relatively flat target surface perpendicular to the axis of the accelerating opening. The effect is diminished if that surface is made convex or concave.

Collection is improved by forming irregularities on the inner surface of the downstream chamber walls adacent the downstream side of the primary barrier in which the accelerating opening is formed. Vanes which extend from the side walls of the chamber and the downstream side of the primary barrier and which lie in planes parallel with the axis of the accelerating opening work very well.

The combination of that vane structure and the fact that the downstream barrier or target has an area like that of the accelerating opening or smaller provides a very significant advantage. A filter unit according to the invention can be produced, by molding, in one unitary and integral structure. The target face is formed by a tool which extends through the accelerating opening and cooperates with a second tool which moves relatively toward and away from the first tool on a line coincident with the axis of the accelerating opening. The second tool forms the downstream chamber, the other surfaces of the target, the lower face of the primary barrier, and the collection valves. Portions of the two tools must engage one another in the region between the accelerating opening and the target to provide a space for smoke flow around the target. Aikman air flow passages can be molded into the inner wall of the upstream cigarette coupler end of the device, because they are also parallel with the axis of the accelerating opening. The result is that a truly low cost, short, one-piece filter unit, with both ambient air dilution and kinetic energy differential separation, can be produced of inexpensive disposable materials.

DESCRIPTION OF THE PREFERRED EMBODIMENT

Figure 1:
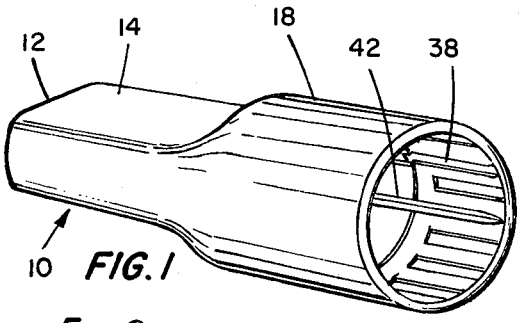
FIG. 1 is an isometric view of a preferred form of filter unit according to the invention.

A cigarette smoke filter unit according to the invention is shown in FIG. 1 where it is generally designated 10. It is a generally cylindrical tube except that the downstream end 12 is flattened on opposite sides to form a bit structure that is more convenient for a smoker to hold between his lips. For identification, the upper flat surface is designated 14. The lower surface is designated 16 and is visible in some of the other figures. The whole unit is approximately 2.5 cm long and 0.8 cm in diameter in the preferred form.

The upstream end of the filter unit 10 is designated 18. It is called the cigarette receiving end of the unit, and is sometimes referred to as the "coupler." A part of the interior surface of the receiving end is visible in FIG. 1. The numeral 20 designates an air flow channel. The number 22 designates one of several inwardly projecting longitudinally extending ribs whose function is to preclude the cigarette wrapper from being squeezed into and blocking channel 20 and the other air flow channels.

Figure 2:
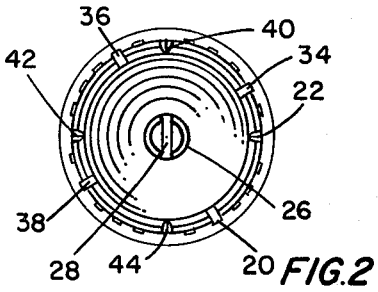
FIG. 2 is an end elevational view of the unit of FIG. 1 as seen from the cigarette receiving end.

A barrier extends across the interior of the filter unit approximately midway along its length. That barrier is visible in FIG. 2 where it is designated 24. An accelerating opening 26 is formed through the barrier 24 on an axis coincident, or substantially so, with the longitudinal axis of the filter unit. A downstream barrier, or target, 28 is visible through the opening 26. Most of the remaining features that are visible are formed at the cigarette receiving end of the unit. The inner diameter is stepped to smaller diameter at successively greater depths within the receiving end of the holder whereby to accommodate and hold cigarettes of different diameter. The numeral 30 identifies the shoulder that occurs at the first step, and the numeral 32 identifies the shoulder at the second step. Four channels in the side walls form air passageways which extend over the length of the cigarette receiving section and permit the passage of air past the cigarette that may be inserted in the receiving end. Air flow passage 20 was identified above. The others are numbered 34, 36 and 38, respectively.

In addition to the inwardly projecting rib 22, there are three others, and they are identified by the reference numerals 40, 42 and 44, respectively.

These conformations, the several ambient air flow passages, and the several inwardly extending ribs, are important because they admit ambient air for mixture with smoke in the mixing chamber downstream from the end of the cigarette. The mixing chamber is that portion of the interior of the cigarette receiving end 18 between the end of the cigarette and the upper face of the primary barrier 24.

In this preferred embodiment, the forward or upstream face is tapered slightly in the downstream direction from the margins of that surface to the central region where the opening 26 is formed. It is preferred that that opening be circular as it is shown to be in the drawings. It has a diameter in the range from 0.75 to 1.2 mm. That range is taught in the prior art in conjunction with their broad secondary structures. The same sizes are useful in this invention, notwithstanding the fact that the downstream barrier has become a small target whose area toward the accelerating opening is less than the cross-sectional area of the opening.

Figure 3:
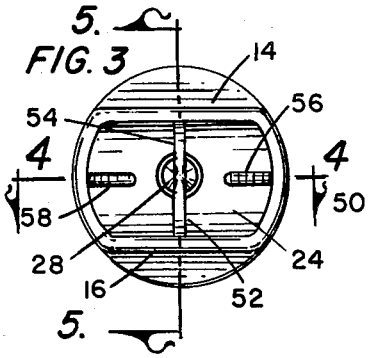
FIG. 3 is an elevational view of the other end of the unit.
Figure 5:
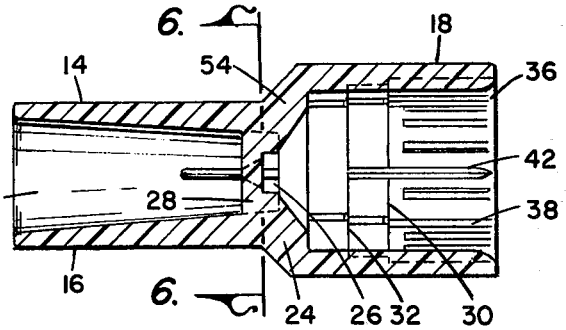
FIG. 5 is a cross-sectional view taken on lines 5—5 of FIG. 3.
Figure 4:
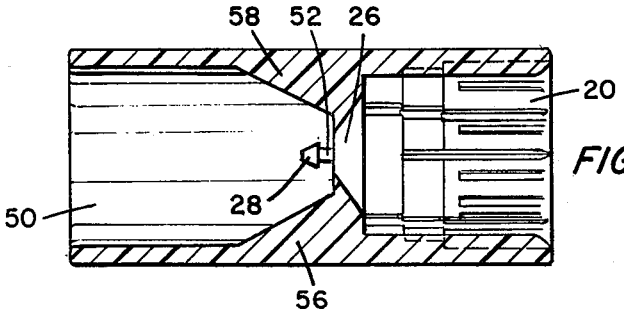
FIG. 4 is a cross-sectional view taken on line 4—4 of FIG. 3.
Figure 6:
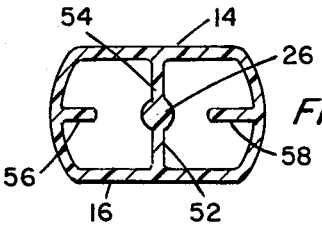
FIG. 6 is a cross-sectional view taken on lines 6—6 of FIGS. 4 and 5.

The target is located so that it is aligned with the accelerating opening. As best shown in FIG. 3 and in FIG. 6, it is mounted, in this embodiment, on two webs which extend in opposite direction from the target to the inner wall of the downstream chamber 50. The two webs are numbered 52 and 54. At their forward end those webs are integral with the downstream face of the primary barrier 24. The webs serve as collection vanes in addition to their function as supports for the target 28. There are two other collection vanes in this design. They are designated 56 and 58, respectively. At their outer edge they are integral with the interior wall of the downstream chamber 50. At their forward ends, those two collection vanes are, like the webs 52 and 54, integrally formed with the rear face of the primary barrier wall 24. As best shown in FIG. 5, the two vanes are triangular in form, diminishing to minimum width in the downstream direction. That triangular form appears to have an advantage, although the collection of tar and nicotine occurs primarily at the juncture of the collection vanes with the downstream surface of the barrier wall and with the inner surface of the downstream chamber 50. There is some collection at the sides of the target, but most of it occurs in the corners at places that are actually upstream from the target itself. If the unit is used in smoking a substantial number of cigarettes, the corner regions eventually become filled with tars and nicotine, and the collection area increases.

Figure 7:
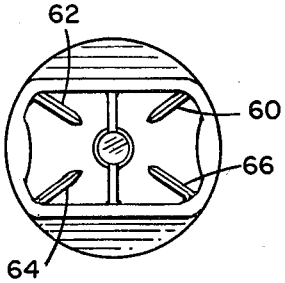
FIG. 7 is a view in smokers end elevation of one alternate form of the invention.

The filter that removes all tar and nicotine is unsuccessful in the sense that smokers will not use it because it alters the taste of the smoke. The filter that is successful, both in removing tar and nicotine and as an aid to withdrawal from the smoking habit, combines ambient air inlet with tar and nicotine separation and collection. Prior art designs have offered a convenient way to alter the proportion of ambient air in the smoke-air mixture by changing the size of the air inlet openings. However, the prior art designs offer no way to alter the percentage of the tar and nicotine that is removed. Each design has its own characteristic in that regard, and any attempt to alter that percentage required a redesign. In this invention, the proportion of the total tar and nicotine that is removed can be varied simply by varying the amount of surface irregularity on the walls around the target. Because the vane structure in which the vanes lie in planes parallel to the axis of the accelerating opening is successful, a convenient way to alter the proportion of liquid and semi-solid removal is simply to change the number of the collection vanes. Thus, the modification shown in FIG. 7, which has four collection vanes 60, 62, 64 and 66, will remove a greater percentage of unwanted material than will the structures shown in FIGS. 1 through 6.

It is important that vanes that are formed in a plane parallel to the axis of the accelerating opening be effective. Such vanes are easily produced with a molding tool that is withdrawn from the lower chamber of the filter on a line coincidend with the axis of the accelerating opening. Such a tool produces the interior surface of the downstream end of the filter except the upstream face of the target 28 and the inner margins of webs 52 and 54 between the upstream face of the target 28 and the downstream face of the primary barrier 24. The inner surfaces of the upstream chamber, the walls of the accelerating opening 26, the inner exposed faces of webs 52 and 54, and the upstream face of target 28 are all produced by a tool that is withdrawn from the filter on a line coincident with the axis of the accelerating opening 26. Those two tools, the downstream tool and the upstream tool, have mating surfaces in the region between the upper face of the upstream surface of the target 28 and the downstream surface of the barrier wall 24 except at the webs 52 and 54. No material is molded at the places where the tools mate so that an air passage is formed at those places.

As best shown in FIGS. 2, 3, 5 and 7, the target in the preferred form of the invention has a diameter smaller than the diameter of the very small accelerating opening. Notwithstanding that, when the face of the target is relatively flat, collection occurs at the upstream region of the downstream chamber. That is unexpected and why it occurs is unknown.

The target diameter is made no larger than the accelerating hole diameter for two reasons. It permits one-piece construction and it improves performance. Target diameters in the range from the diameter of the accelerating opening to one-half of that diameter work well. That means that the dimensions of what is a very tiny target are not critical. For practical reasons, primarily molding tool production and maintainance, it is preferred that the target be no greater in size than the size of the accelerating opening.

Although I have shown and described certain specific embodiments of my invention, I am fully aware that many modifications thereof are possible. My invention, therefore, is not to be restricted except insofar as is necessitated by the prior art.

I claim:

1. A cigarette filter comprising:

a tubular member having an upstream end for receiving the end of a cigarette and a downstream end serving as a smoker's bit;

a barrier wall extending across said member at a point intermediate said upstream and said downstream ends;

an opening in the central region of said barrier affording communication past said barrier from said upstream to said downstream end; and a target disposed adjacent to and entirely downstream from said barrier, said target being axially aligned with said opening and having an area, at the side toward said opening, no greater than the cross-sectional area of the opening.

2. The invention defined in claim 1 in which said side of the target toward said hole is disposed at a distance from said hole which is less than the diameter of said hole.

3. The invention defined in claim 1 in which said opening is circular and has a diameter in the range 0.75 to 1.2 millimeters.

4. The invention defined in claim 1 in which the area of said target at the side toward said opening is no less than one-half of the area of said opening and has its center aligned with the center of said opening.

5. A cigarette filter comprising:

a tubular member having an upstream end for receiving the end of a cigarette and a downstream end serving as a smoker's bit;

a barrier wall extending across said member at a point intermediate said upstream and said downstream ends;

and opening in the central region of said barrier affording communication past said barrier from said upstream to said downstream end;

a target disposed adjacent to and downstream from said barrier, said target being aligned with said opening and having an area, at the side toward said opening, no greater than the cross-sectional area of the opening; and collector vanes formed on the inner surface of said downstream end opposite the space between said target and said opening.

6. A cigarette filter comprising:

a tubular member having an upstream end for receiving the end of a cigarette and a downstream end serving as a smoker's bit;

a barrier wall extending across said member at a point intermediate said upstream and said downstream ends;

an opening in the central region of said barrier affording communication past said barrier from said upstream to said downstream end;

a target disposed adjacent to and downstream from said barrier, said target being aligned with said opening and having an area, at the side toward said opening; no greater than the cross-sectional area of the opening;

said side of the target toward said hole being disposed at a distance from said hole which is less than the diameter of said hole; and further comprising vanes formed on the inner surface of said downstream end oppisite the space between said target and said opening.

7. The invention defined in claim 1 in which the face of said target toward said opening is substantially perpendicular to the center line of said opening.

8. The invention defined in claim 4 in which the face of said target toward said opening is substantially perpendicular to the center line of said opening.

9. The invention defined in claim 2 which further comprises means for introducing ambient air into said receiving end of said member in parallel with the smoke from a cigarette disposed in said receiving end.

10. A cigarette filter comprising:

a tubular member having an upstream end for receiving the end of a cigarette and a downstream end serving as a smoker's bit;

a barrier wall extending across said member at a point intermediate said upstream and said downstream ends;

an opening in the central region of said barrier affording communication past said barrier from said upstream to said downstream end;

a target disposed adjacent to and downstream from said barrier, said target being aligned with said opening and having an area, at the side toward said opening, no greater than the cross-sectional area of the opening;

said side of the target toward said hole being disposed at a distance from said hole which is less than the diameter of said hole;

means for introducing ambient air into said receiving end of said member in aprallel with the smoke from a cigarette disposed in said receiving end; and the opening in the barrier being circular, its axis substantially coincident with that of the tubular member and its diameter in the range 0.75 to 1.2 millimeters.

11. The invention defined in claim 10 which further comprises collector vanes formed on the inner surface of the bit end of said member, said vanes extending from said inner surface inwardly toward said target opposite the region of the space between the target and said barrier wall.

12. The invention defined in claim 11 in which said target is formed with a flat surface facing said opening and having an area no less than one-half of the cross-sectional area of said opening.

13. The method of making a cigarette filter of the kind which comprises a tubular member having a barrier wall extending across the midregion of the interior of said member and a target downstream and spaced from a central smoke flow opening in the barrier, which method comprises the steps of:

molding the face of the target with one tool extending through what remains as the smoke flow opening; and simultaneously molding the sides and downstream end of the target with a second tool which engages the walls of the first tool at points intermediate the face of the target and the flow opening.

14. The invention defined in claim 13 in which the molding steps are conducted after moving the first and second tools relatively toward one another on a line coincident with the axis of the flow opening so produced; and retracting the first and second tools relatively along said line following completion of the molding.

15. The invention defined in claim 13 which comprises the further step of molding a plurality of collector vanes on the interior wall of said tubular member simultaneously with molding the target, the vanes extending in a direction parallel to said line and at spaced points around said line.

* * * * *